United States Patent [19]

Umlauf

[11] Patent Number: 4,527,723

[45] Date of Patent: Jul. 9, 1985

[54] CHAIN BRIDLE EQUIPMENT FOR KEEPING METAL STRIP TENSIONS AT A CONSTANT LEVEL

[76] Inventor: Norbert Umlauf, Haferkamp 64, 5800 Hagen, Fed. Rep. of Germany

[21] Appl. No.: 472,674

[22] Filed: Mar. 7, 1983

[30] Foreign Application Priority Data

Mar. 8, 1982 [DE] Fed. Rep. of Germany ..... 3208158

[51] Int. Cl.[3] ..... B65H 17/34

[52] U.S. Cl. ..... 226/172; 400/635

[58] Field of Search ..... 226/172, 171, 170, 74, 226/75, 108; 400/616.1, 635; 254/135; 474/101, 111

[56] References Cited

U.S. PATENT DOCUMENTS

| | | | |
|---|---|---|---|
| 3,669,329 | 6/1972 | Blanchet et al. | 226/108 |
| 3,680,342 | 8/1972 | Mott et al. | 226/172 X |
| 3,881,647 | 5/1975 | Wolfe | 226/172 |
| 4,135,620 | 1/1979 | Harcuba et al. | 198/836 |

*Primary Examiner*—Leonard D. Christian

*Attorney, Agent, or Firm*—Toren, McGeady, Stanger

[57] ABSTRACT

Strip processing lines require tension or back tension to be applied to the strip, as the case may be. These requirements are best met by the proposed chain bridle.

The recoiling of adjacent slit strips on a tension reel will result in varying rewinding speeds and tensions due to the different thickness of the individual strands. Thick strands will be rewound too tight and thin strip too loose. Therefore, the chain bridle is installed before the tension reel to keep the tension of the various strands or a wide strip at a constant value. The strip (1) is clamped between two circulating chain systems (4*a*,4*b*), one arranged below and the other above the strip passline. One chain system (4*b*) is fixed, the other one (4*a*) is adjustable. The chain segments (4) of the chain systems (4*a*,4*b*) are provided with a covering and are moved parallel to the strip (1) through support rolls (5) and guide gibs (6*a*) with entry and exit guide curves (6) with the latter ensuring an adequate clamping pressure of the relevant opposite chain segments (4). The segment covering (7) may consist of an elastic coating (11) provided with additional shapes or profiled surfaces (12).

7 Claims, 8 Drawing Figures

4
11
12

CHAIN BRIDLE EQUIPMENT FOR KEEPING METAL STRIP TENSIONS AT A CONSTANT LEVEL

SUMMARY OF THE INVENTION

This invention is direct to a chain bridle system for producing tension and back tension, particularly for keeping the tension of slit strips at a constant level, as they are wound on a tension reel with a braking effect on each single strand, and for building up and eliminating tension on strip processing lines as well as in areas between tension levellers.

Metal strip is moved on processing lines preferably by the use of pinch roll units or bridles. The necessary strip tension on such lines is produced particularly by conventional bridles in addition to pinch roll units and reels, which may produce a similar effect. The bridle rolls are all driven and more or less wound around by the strip. Strip tensions may be built up or eliminated from roll to roll within pressed limits. Strip deflections require additional drive power and are undesirable for metallurgical and technological reasons. Normal pratice shows that, for reasons of economy, the choice of roll diameters is such that parts of the strip are plastically deformed, even if light-gauge material is used. These disadvantages are of grave importance particularly in connection with the use of heavy-gauge strip, stainless steel strip and with special material qualities as for example silicon strip or strip having a high surface sensitivity.

These disadvantages are eliminated by the chain bridle equipment as hereafter described. Further advantages of this system are that the strip advance has no damaging effect on the strip surface because there are no relative motions, and the specific load can be kept to a minimum; in addition, less space is required in particular in case of big differences in tensions and heavy-gauge strips, and the purchase price for this system is considerably lower than that for a bridle.

The chain bridle equipment can be used particularly for producing back tension, when slit strips are recoiled.

During the recoiling operation the adjacent slit strands will form different slit coil diameters due to varying strip gauges originating from the geometry of the rolled wide strip. This again results in varying recoiling speeds and tensions. Heavy-gauge slit strands will be wound too tightly and light-gauge material too loosely.

To achieve uniform slit coils, retaining or brake units are often used, which balance varying strip tensions during the recoiling operation without directly affecting the surface of the slit strands. A well-known retaining device (DE PS 1 804 178) consists of a number of rings, rotating with friction around a shaft preceding the tension reel. The braking torque permits adjustment to a maximum strip tension by the axial supply of a pressure fluid with the braking torque being transmitted to the faces of the ring hubs by inflatable chambers located between the rings and pressing against friction disks. If higher tensions occur, the relevant rings will perform balancing rotary motions in relation to the rotations of the shaft and the other rings. This type of retaining device is very expensive due to a great number of precisely machined brake disks and to the braking surfaces provided on the ring hubs. In addition, this strip retaining device implies the disadvantage that a facility is required to produce an initial tension in order to obtain subsequently an increased tension.

This invention tends to avoid these disadvantages by providing a simple and reliable facility to keep the tension of slit and wide strips at a constant value without the use of an additional pinch roll unit. When wide strip material is pulled from a slack loop with a tendency to strip mistracking, the sophisticated and expensive steering and pinch roll unit does not have to be applied, since the perpendicular entry of the strip into the chain bridle will be achieved by the pivot motion of the new system.

The new invention solves this task by the use of two circulating chain systems, between which the metal strip will be clamped. Further special features of this new system are the following: the support segments of the chain systems will be guided in alignment with the strip and will be opposed to each other by pairs; the contact surfaces with the metal strip will have a high friction coefficient whereas the support surface will have a low friction coefficient by the use of slideways or support rollers; the particular type, shape, thickness and hardness degree of the segment coating compound will offer an adequate elasticity meeting any tension requirements.

All the above factors will permit holding the strip without any relative motion between the strip and the segment coating areas and the strip surface free from any changes, particularly when highly sensitive strip is processed. The support rollers will approach the support area via a guide curve so that they will come into smooth contact with the strip.

The chain bridle used on slitting lines will preferably be adjusted to the lowest possible speed of the strands. The strands running at higher speeds will be in advanced position when contacted by the chain systems. This will result in varying strand lengths, which will be compensated for by the elasticity of the segment coating, which will first be compressed and then spring back within the area of the advanced strand position. The specific tension in the strand section will change only negligibly during this process, since the pressing forces will be distributed over a comparatively large area. FIGS. 5 to 5*b* are schematic representations of these relations, FIG. 5 showing the process at a strand travelling speed=peripheral velocity, FIG. 5*a* showing the process at a strand travelling speed>peripheral velocity, and FIG. 5*b* showing the process at a strand travelling speed>>peripheral velocity. Another important effect is that, by the configuration of the guide curve, a pretension will be applied to the segment covering, which, for practical reasons, should be designed as grouser bars.

The chain bridle as described above will permit recoiling strands at an unvarying tension regardless of any thickness changes. The pressing forces of the chain system will allow for an infinite control of tension and back tension within large areas. By the use of additional chain wheels or support elements the transmission of forces can be considerably increased.

The chain bridle is particularly suited to take the place of conventional bridles on strip processing lines. This implies the advantage that the necessary strip tension can be increased from zero tension to maximum tension, as required in normal practice.

Tension levellers are provided with a maximum of five bridle rolls at their entry and exit side to produce the necessary strip tensions. It is expedient to provide a separate D.C. drive for each bridle roll or a mechanical connection with a D.C. equalizing gear motor. This seems to be even indispensable, because relative velocities need to be avoided due to the manufacturing accuracies and to the non-uniform wear of the bridle roll covering. However, this will require a considerable amount of mechanical and electrical equipment and great deal of space. If the chain bridle is used for the same application, only one unit will be required for the tension leveller entry and exit side, and consequently no more than two drives.

On modern strip processing lines it is advisable to install a strip centerguide control preceding and following each bridle so that the strip can enter the bridle on the centerline of the line. A particular design of the chain bridle ensures that the strip enters the chain systems at right angle to the chain segments through a pivoting movement performed by the chain bridle on strip passline level.

If installed before a tension reel, the chain bridle will be designed for adjustment to the steadily varying entry angle of the incoming strip. This arrangement implies the advantage that the strip back tension will be produced right before the tension reel.

BRIEF DESCRIPTION OF THE DRAWING

The following drawings show a design example of a chain bridle.

DETAILED DESCRIPTION OF THE INVENTION

Figure 1:
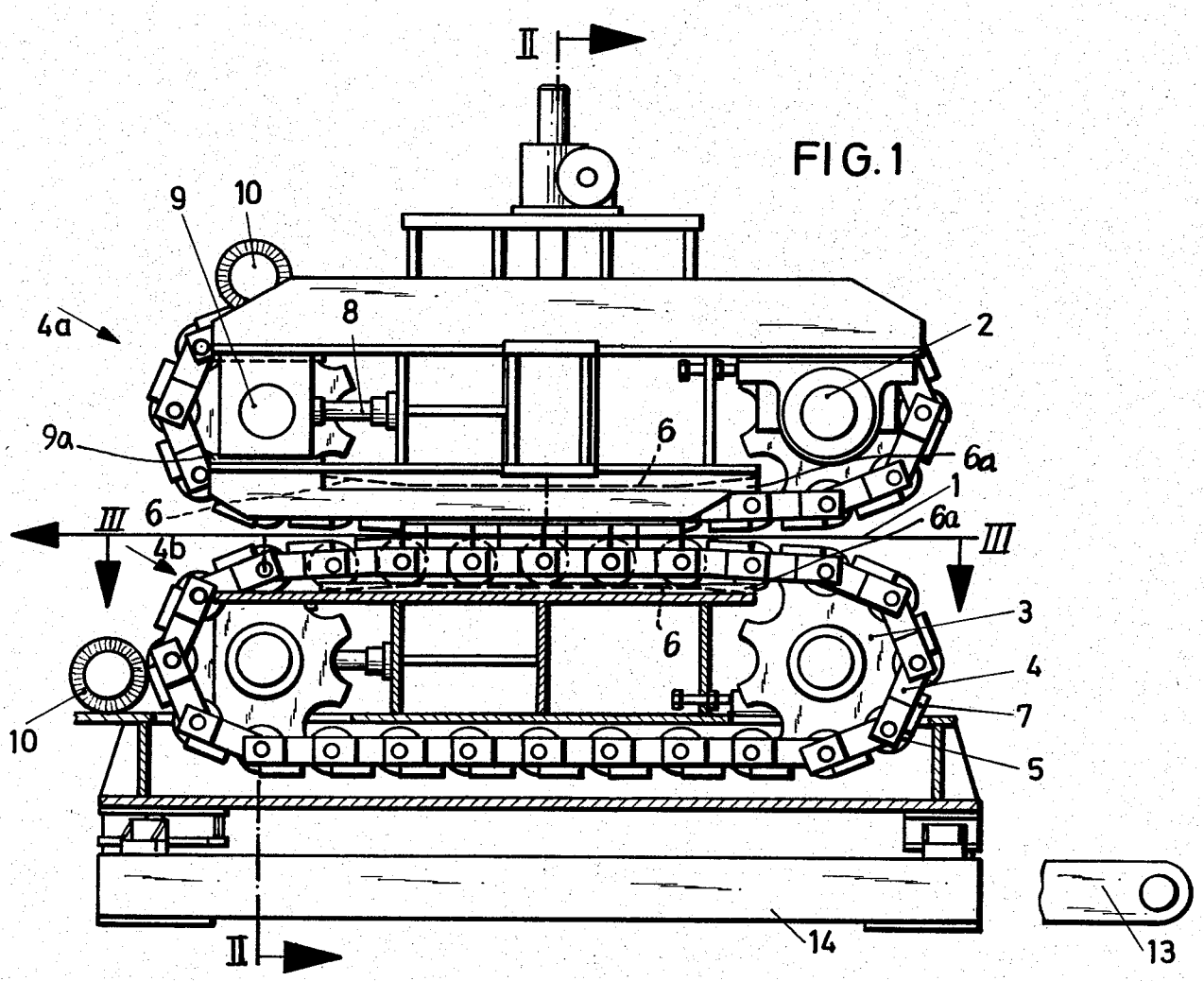
FIG. 1 is a schematic representation of the side view and section along line I—I of FIG. 2 showing a chain bridle with the chain system.

If the chain bridle is installed in a slitting line to produce back tension, the single strands would be fed from the slitter to the tension reel, running through a loop system with deflector roll, through the chain bridle, as shown in FIG. 1, and over another deflector roll. The actual chain bridle will remain unchanged for all slitting programs.

Figure 2:
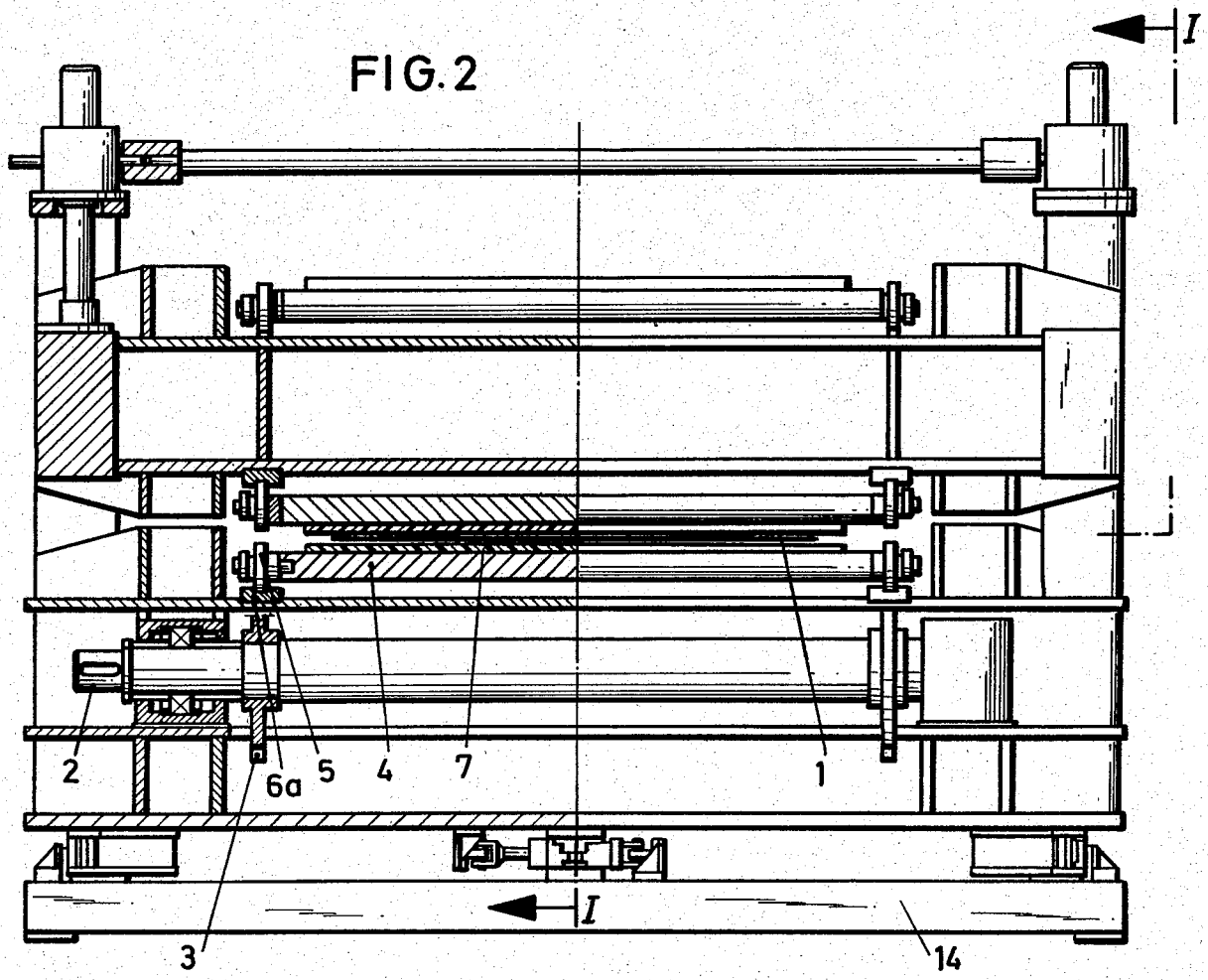
FIG. 2 is a section along line II—II of FIG. 1.
Figure 3:
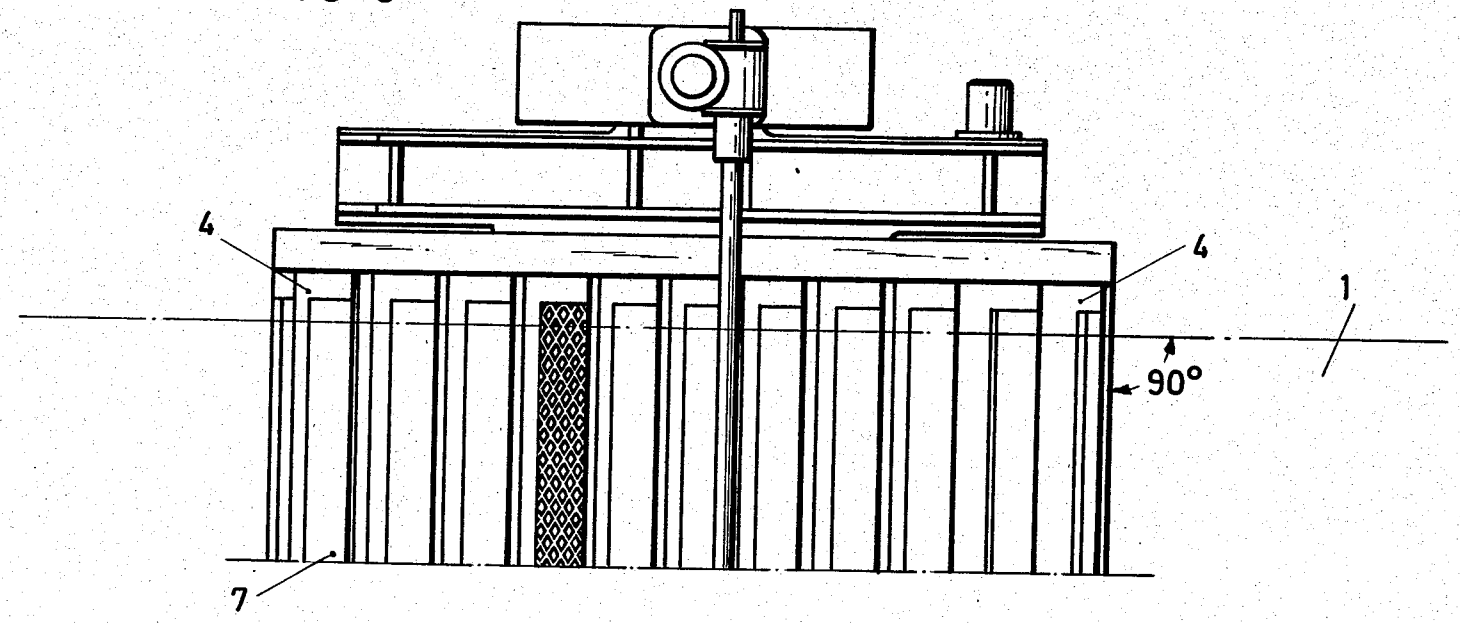
FIG. 3 is a section along line III—III of FIG. 1.
Figure 4A:
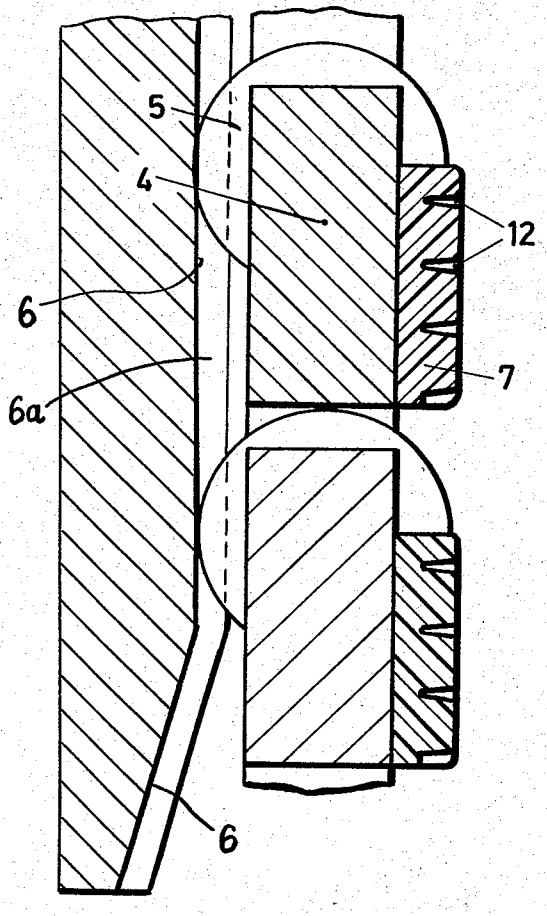
FIG. 4*a* is a section along line IV—IV of FIG. 4.
Figure 4:
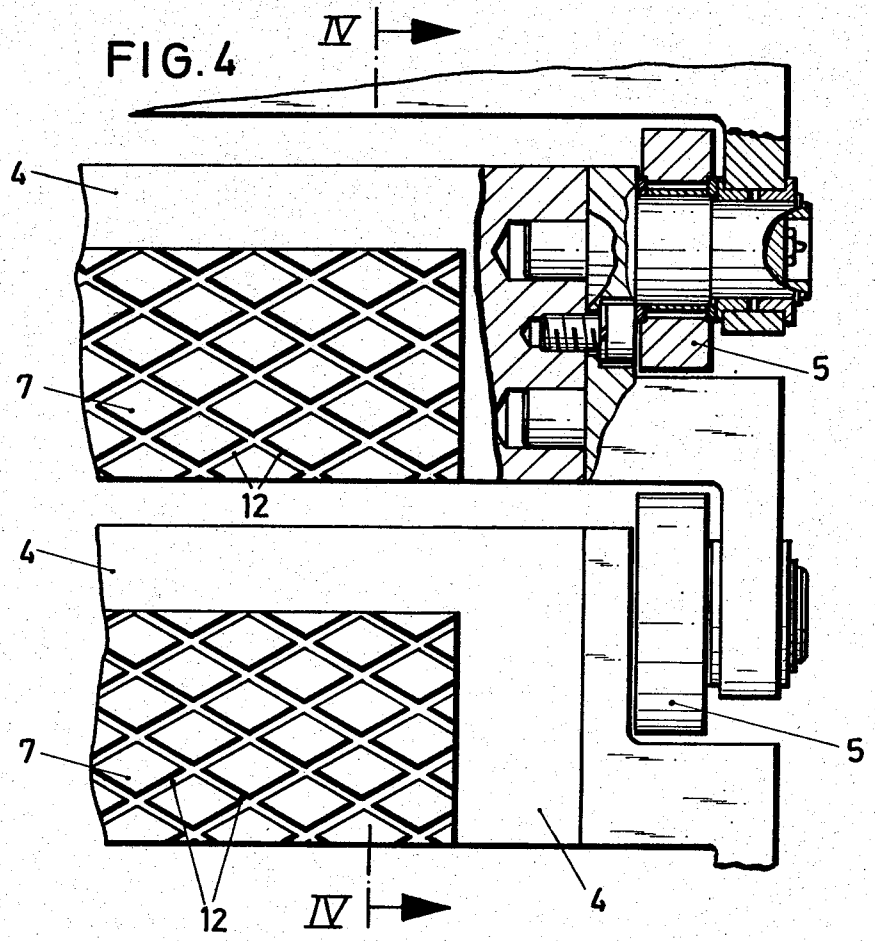
FIG. 4 is a partial section of chains with coated segments.
Figures 5, 5A, 5B:
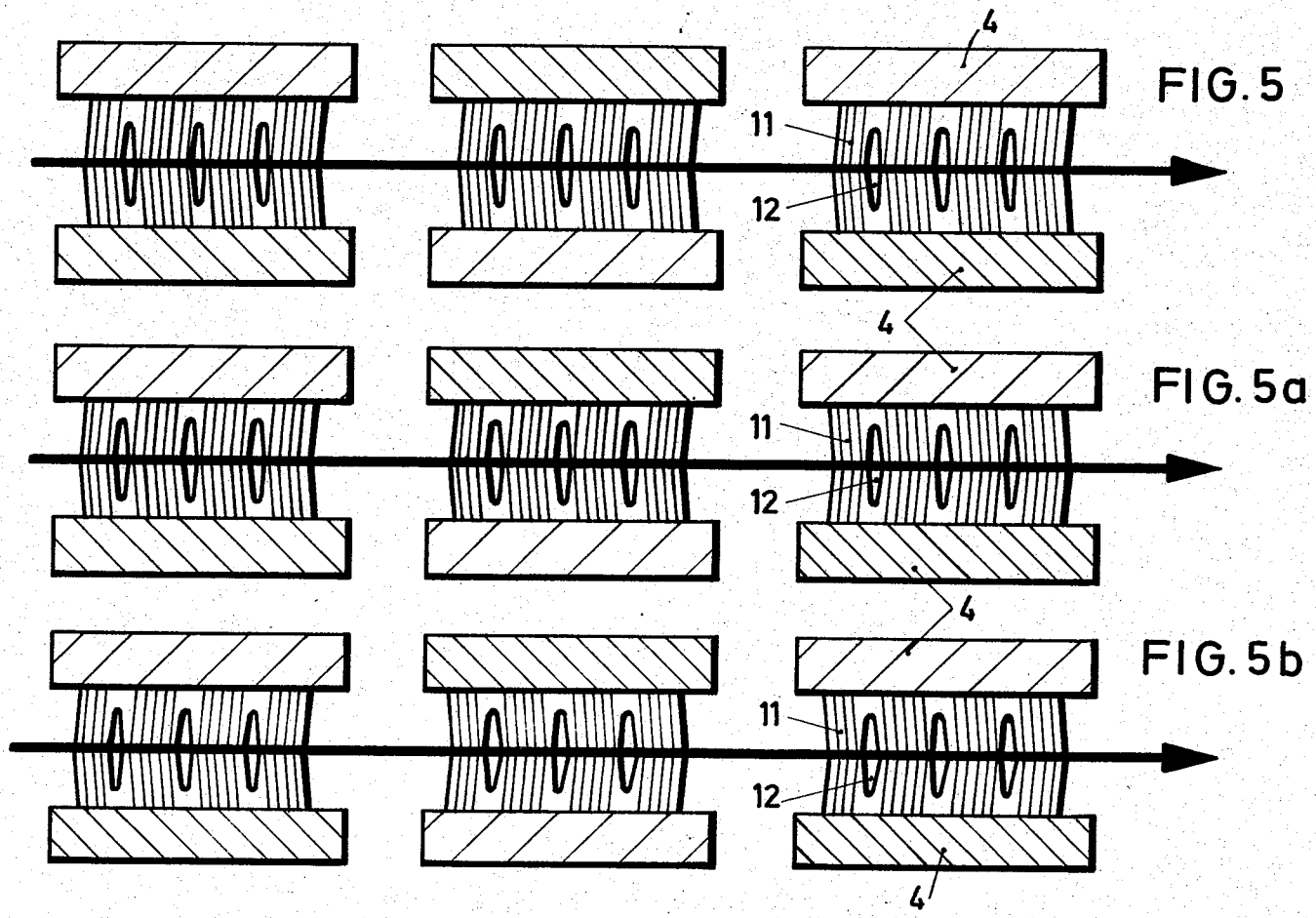
FIGS. 5, 5*a*, 5*b* are schematic representations of segment coating fiber configuration at various positions.

Preferably, the chain systems (4*a*,4*b*) are driven by a D.C. motor, not shown, followed by a gearing unit or cogged wheel gear, note chain wheel 3. Each chain wheel system has a pair of laterally spaced sets of chain segments (4), see FIG. 2. The braking torques are transmitted from shaft (2) to the chain wheels (3) and then via the support rollers (5) to the chain segments (4) of the chain systems (4*a*,4*b*). The support rollers (5) transmit the braking torques, and at the same time support the chain segments (4) within the strip contact area between the two chain systems through the guide gibs (6*a*) and the entry and exit guide curves formed in the guide gibs, and clamping section (6) formed by the guide gibs, the strip (1) is clamped by opposed chain segments (4) of the top and bottom chain systems (4*a*,4*b*) between the segment coverings (7), which is designed as an elastic coating (11) with a profiled surface (12). The bottom chain system (4*b*) is fixed, while the top chain system (4*a*) is adjustable. The pressure forces can be controlled. As is shown in FIG. 2, the adjustable top chain system can be performed mechanically or hydraulically, as is known in the art. The adjustment can be carried out effectively on both sides. note FIG. 2. By a separate control for both sides, a uniform contact pressure can be obtained for the entire chain segment. The initial tension in the top chain system (4*a*) is applied by a cylinder (8) mechanically or hydraulically shifting a bearing box (9) on guide-ways (9*a*). The oscillating and rotating brush (10) above the upper run of the top chain system (4*a*) removes any impurities adhering to the contact surfaces.

The bottom fixed chain system (4*b*) may also be replaced by a rocker type design (13), which permits an angular adjustment of the chain bridle in relation to the incoming strip (1). The pivot frame (14) located below the bottom chain system (4*b*) is provided to pivot the total chain bridle on strip passline level to achieve a perpendicular entry of the strip in those cases where the strip approaches the chain segments at an angle other than 90°. These functions can be automatically controlled according to the actual known technological standard conventional for such systems.

I claim:

1. A device for applying tension and back tension to metal strip, such as narrow strips to be wound up under separate back tension such as in strip lines, comprising two oppositely arranged endless revolving chain systems forming a region therebetween in which a strip is to be clamped, each of said chain systems comprising a plurality of chain segments (4) which clamp the strip therebetween, wherein the improvement comprises one of said chain systems is located above the other providing an upper said chain system (4*a*) and a lower said chain system (4*b*), an upper gib (6*a*) is located in said upper chain systems and a lower guide gib (6*a*) is located in the lower one of said chain systems, said upper and lower guide gibs (6*a*) support said chain segments in the region of said chain systems in which the strip is clamped therebetween, and each of said upper and lower guide gibs (6*a*) has an inlet end and an outlet end in spaced relation with an inlet curve at the inlet end and an outlet curve at the outlet end, so that said chain segments of said upper and lower chain systems moving over said inlet end gradually approach one another and moving over said outlet ends gradually move away from one another.

2. A device, as set forth in claim 1, wherein a pivot frame (14) is located below said lower chain system and pivotally supports said upper and lower chain systems (4*a*,4*b*).

3. A device, as set forth in claim 1, wherein each of said upper and lower chain systems comprises rollers for supporting said chain segments with said rollers supported on said guide gibs (6*a*) in the region of said chain systems in which the strip is clamped.

4. A device, as set forth in claim 1, wherein guiding surfaces support said chain segments (4) against said guide gibs (6*a*).

5. A device, as set forth in claim 1, wherein said chain segments (4) of said upper and lower chain systems (4*a*,4*b*) each have coatings (7) thereon facing the coatings on the oppositely arranged said chain segments (4).

6. A device, as set forth in claim 5, wherein said coatings comprise an elastic coating support.

7. A device, as set forth in claim 6, wherein the surface of said elastic coating support facing an oppositely disposed elastic coating support has a profiled surface.

* * * * *